US009700807B1

(12) United States Patent
Jones

(10) Patent No.: US 9,700,807 B1
(45) Date of Patent: Jul. 11, 2017

(54) VERTICALLY ROTATING CHAIR ASSEMBLY

(71) Applicant: James Jones, Tuscon, AZ (US)

(72) Inventor: James Jones, Tuscon, AZ (US)

( * ) Notice: Subject to any disclaimer, the term of this patent is extended or adjusted under 35 U.S.C. 154(b) by 0 days.

(21) Appl. No.: 15/217,402

(22) Filed: Jul. 22, 2016

(51) Int. Cl.

| | |
|---|---|
| ***A63G 27/02*** | (2006.01) |
| ***A47D 13/00*** | (2006.01) |
| ***A63G 27/08*** | (2006.01) |
| ***A63G 1/10*** | (2006.01) |

(52) U.S. Cl.
CPC ..... *A63G 27/08* (2013.01); *A47D 13/00* (2013.01); *A63G 1/10* (2013.01)

(58) Field of Classification Search
CPC ..... A63G 19/00; A63G 19/04; A63G 19/16; A63G 27/00; A63G 27/02; A47D 13/00; A47D 13/02; A47D 13/025; A47D 13/10; A47D 13/105; A47D 9/00; A47D 9/02
USPC ..... 472/14, 16, 17, 44, 45, 117, 119; 297/273
See application file for complete search history.

(56) References Cited

U.S. PATENT DOCUMENTS 289,541 A 12/1883 Jackson
1,599,014 A * 9/1926 Hunter ..... A63G 27/00 472/16
3,127,169 A 3/1964 Guihan
4,240,623 A 12/1980 Edwards
D289,623 S 5/1987 Inoue et al.
5,256,108 A * 10/1993 Whitmore ..... A63B 19/04 472/16
5,378,196 A 1/1995 Pinch et al.
5,562,548 A * 10/1996 Pinch ..... A47D 13/105 297/256.12
5,833,545 A * 11/1998 Pinch ..... A47D 13/105 297/273
D428,638 S 7/2000 Tucker et al.
6,110,048 A 8/2000 Murray
6,283,870 B1 * 9/2001 Saint ..... A47D 13/105 185/43
7,727,078 B2 * 6/2010 Arnold, IV ..... A47C 7/725 446/227
8,469,832 B2 6/2013 Gillett et al.
8,602,903 B2 12/2013 Gilbert
D708,691 S 7/2014 Laurin

* cited by examiner

*Primary Examiner* — Kien Nguyen

(57) ABSTRACT

A vertically rotating chair assembly for rotating a child includes a plate. A pair of supports is coupled singly to opposing edges of the plate. The supports extend substantially vertically from the plate. An axle is rotatably coupled to and extends between the supports distal from the plate. A pair of flanges is coupled singly proximate to opposing ends of the axle. A plurality of crossbars is coupled to and extends between the flanges proximate to circumferences of the flanges. A seat, which is configured to position a child, is rotatably coupled to a respective crossbar. An actuator is coupled to an outside face of a respective support. The actuator is operationally coupled to the axle. The actuator is positioned to motivate rotation of the axle such that the flanges, the crossbars, the seat and a child positioned in the seat rotate vertically around the axle.

15 Claims, 6 Drawing Sheets

VERTICALLY ROTATING CHAIR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to chair assemblies and more particularly pertains to a new chair assembly for rotating a child.

BRIEF SUMMARY OF THE INVENTION

An embodiment of the disclosure meets the needs presented above by generally comprising a plate. A pair of supports is coupled singly to opposing edges of the plate. The supports extend substantially vertically from the plate. An axle is rotatably coupled to and extends between the supports distal from the plate. A pair of flanges is coupled singly proximate to opposing ends of the axle. A plurality of crossbars is coupled to and extends between the flanges proximate to circumferences of the flanges. A seat, which is configured to position a child, is rotatably coupled to a respective crossbar. An actuator is coupled to an outside face of a respective support. The actuator is operationally coupled to the axle. The actuator is positioned to motivate rotation of the axle such that the flanges, the crossbars, the seat and a child positioned in the seat rotate vertically around the axle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
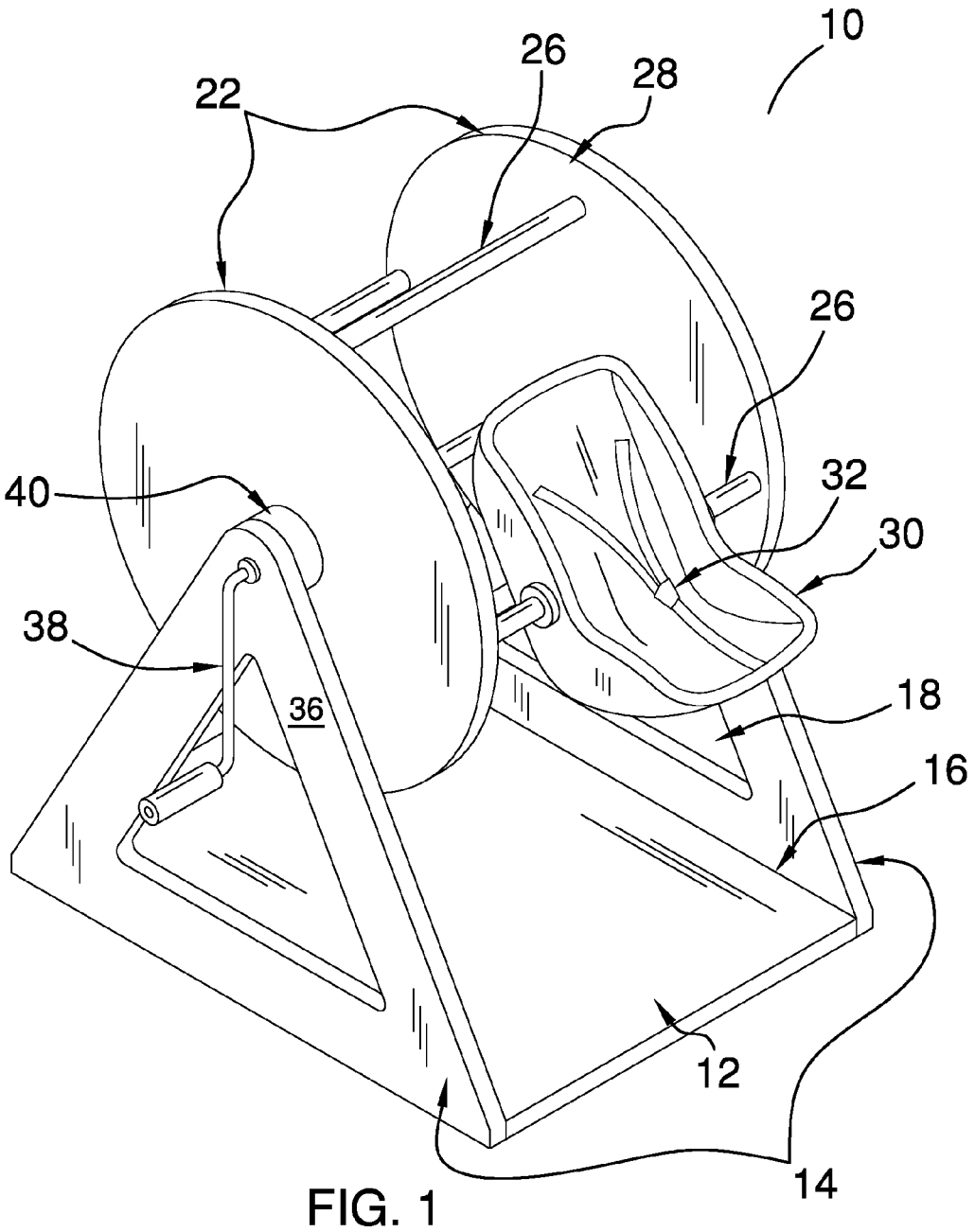
FIG. 1 is an isometric perspective view of a vertically rotating chair assembly according to an embodiment of the disclosure.
Figure 2:
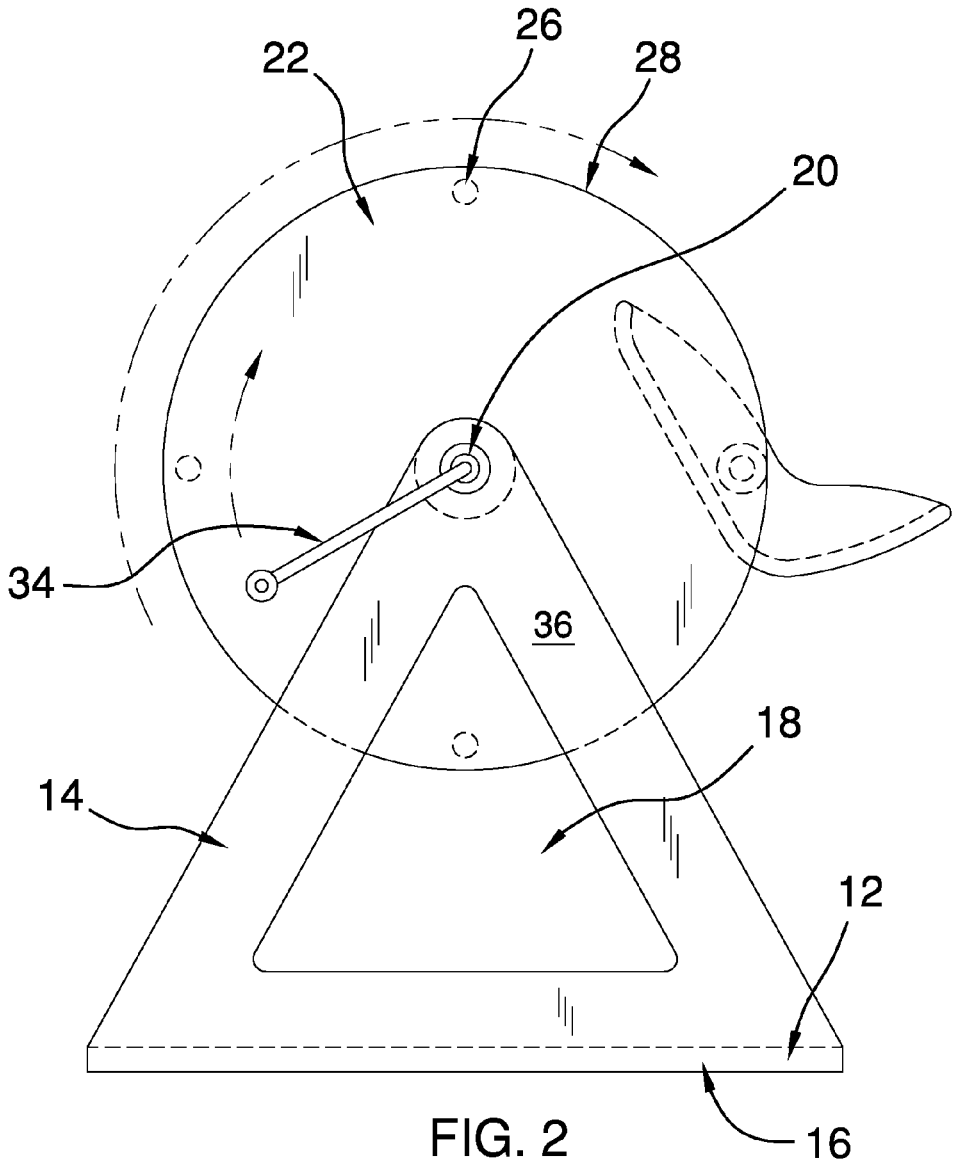
FIG. 2 is a side view of an embodiment of the disclosure.
Figure 3:
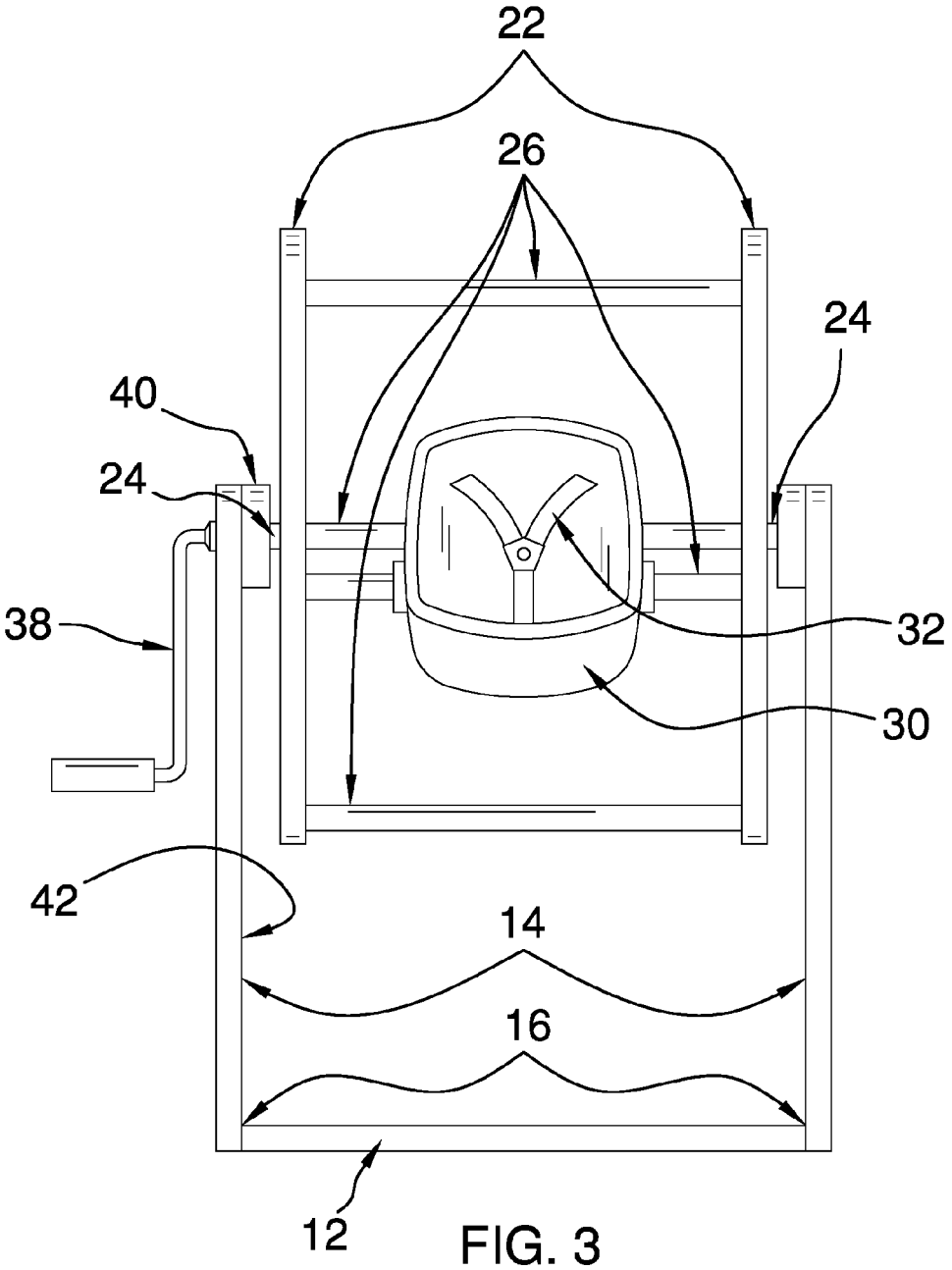
FIG. 3 is a front view of an embodiment of the disclosure.
Figure 4:
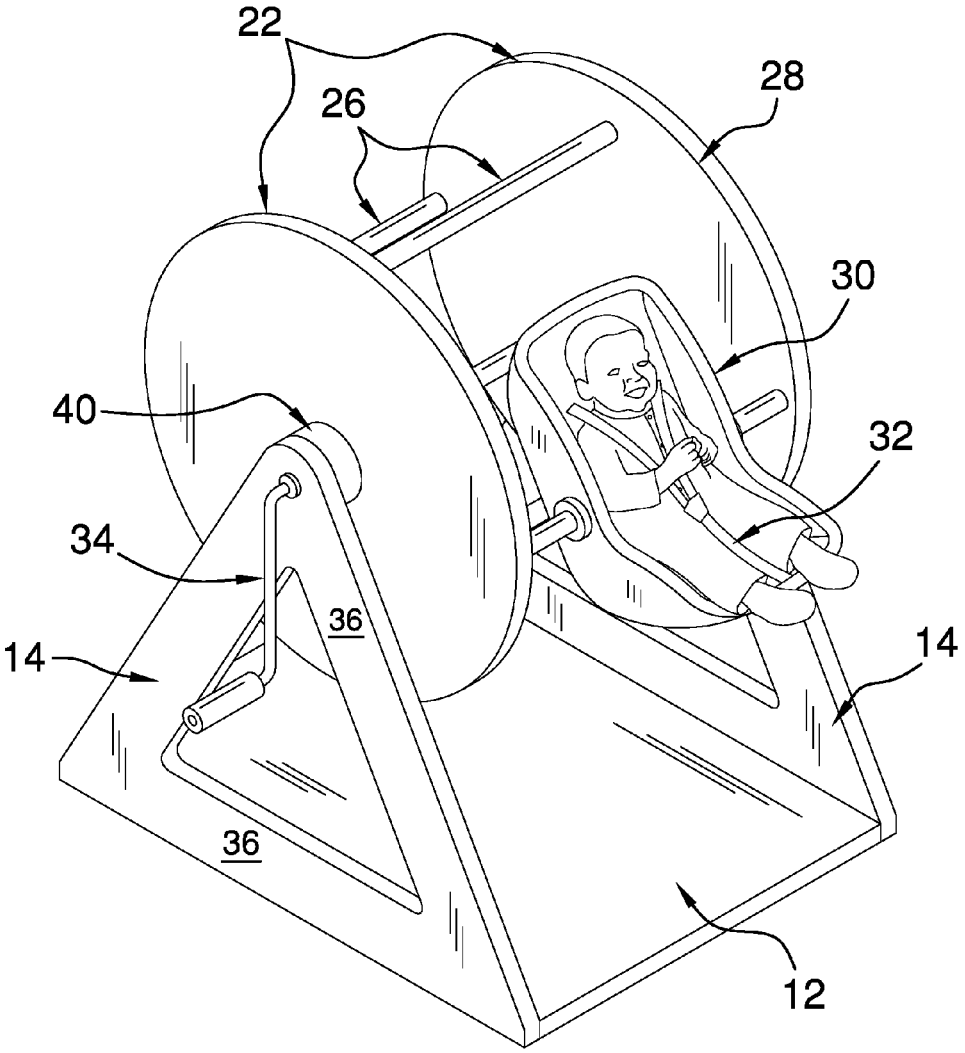
FIG. 4 is an in-use view of an embodiment of the disclosure.
Figure 5:
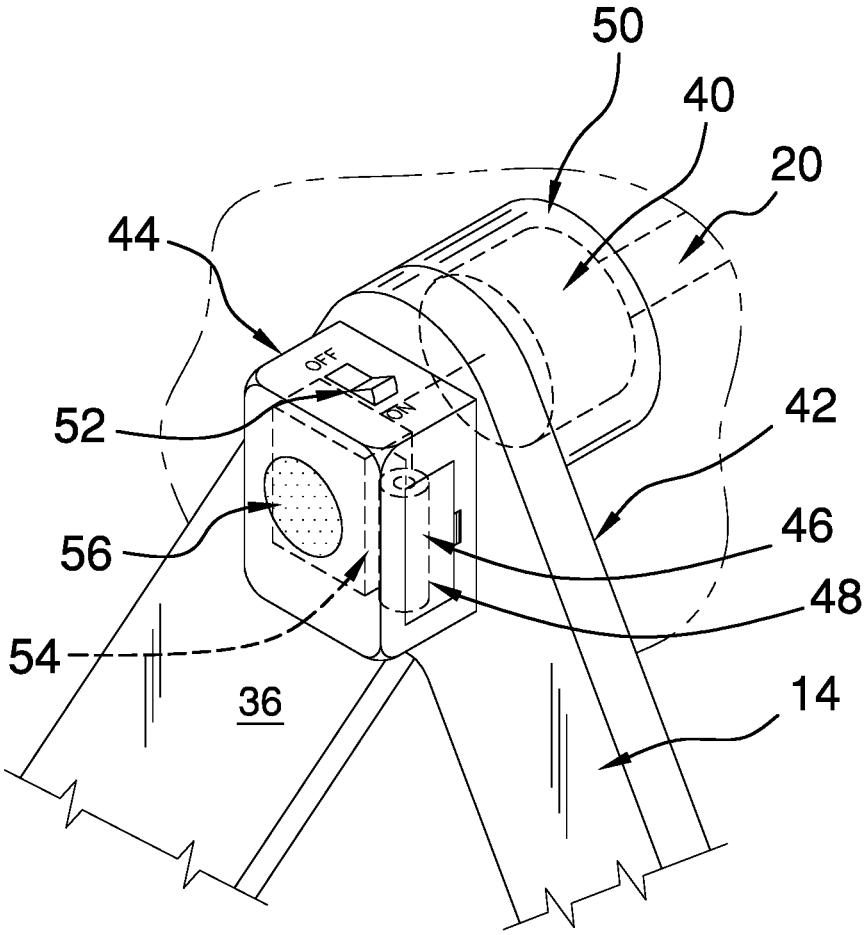
FIG. 5 is a detail view of an embodiment of the disclosure.
Figure 6:
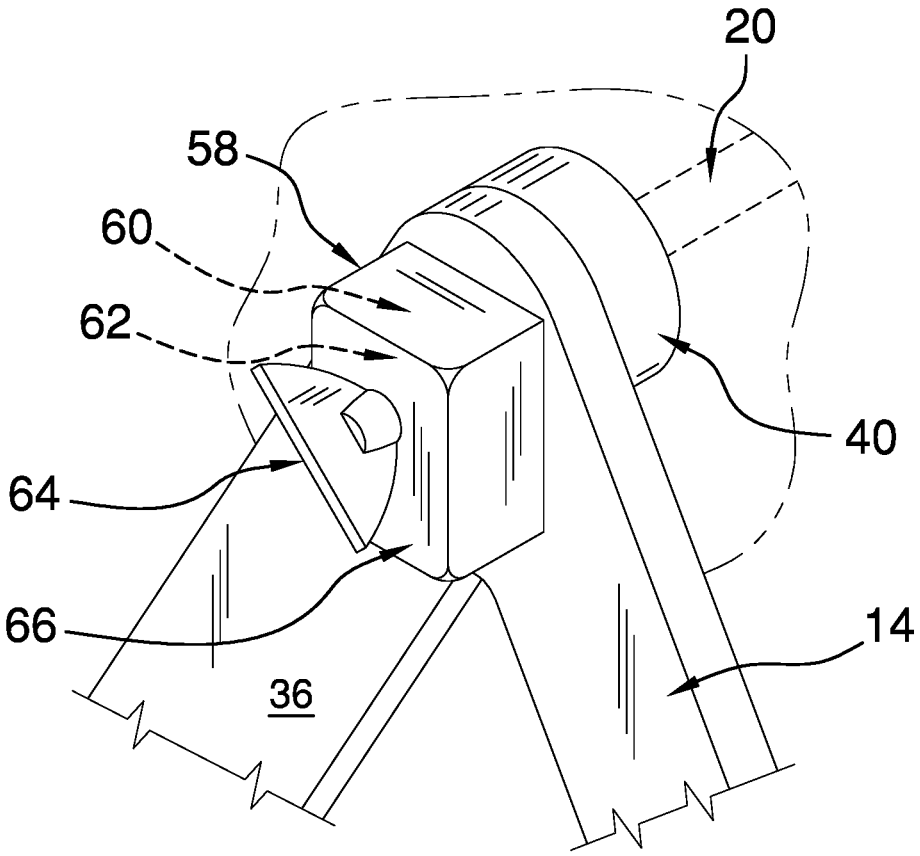
FIG. 6 is a detail view of an embodiment of the disclosure.

With reference now to the drawings, and in particular to FIGS. 1 through 6 thereof, a new chair assembly embodying the principles and concepts of an embodiment of the disclosure and generally designated by the reference numeral 10 will be described.

As best illustrated in FIGS. 1 through 6, the vertically rotating chair assembly 10 generally comprises a plate 12 that is substantially rectangularly shaped. A pair of supports 14 is coupled singly to opposing edges 16 of the plate 12. The supports 14 extend substantially vertically from the plate 12. In one embodiment, the supports 14 are substantially triangularly shaped. In another embodiment, each of a pair of cutouts 18 is substantially centrally positioned through a respective support 14. The cutouts 18 are substantially triangularly shaped.

An axle 20 is rotatably coupled to and extends between the supports 14 distal from the plate 12. A pair of flanges 22 is coupled singly proximate to opposing ends 24 of the axle 20. The flanges 22 are substantially circularly shaped. A plurality of crossbars 26 is coupled to and extends between the flanges 22 proximate to circumferences 28 of the flanges 22. In one embodiment, the plurality of crossbars 26 comprises four crossbars 26 evenly spaced around the circumferences 28. The crossbars 26 are circularly shaped when viewed longitudinally.

A seat 30 is rotatably coupled to a respective crossbar 26. The seat 30 is configured to position a child. In one embodiment, a harness 32 is coupled to the seat 30. The harness 32 is configured to position over the child that is positioned in the seat 30, such that the child is coupled to the seat 30.

An actuator 34 is coupled to an outside face 36 of a respective support 14. The actuator 34 is operationally coupled to the axle 20. In one embodiment of the invention, the actuator 34 comprises a crank handle 38.

A gearbox 40 is coupled to an inside face 42 of the respective support 14. The gearbox 40 is operationally coupled to the actuator 34 and the axle 20. The gearbox 40 is positioned to provide speed and torque conversion between the actuator 34 and the axle 20.

In another embodiment of the invention, the actuator 34 comprises a first housing 44 that is coupled to the outside face 36 of the respective support 14. The first housing 44 is substantially rectangularly box shaped. A power module 46 is coupled to and positioned in the first housing 44. In one embodiment, the power module 46 comprises at least one battery 48. A motor 50 is coupled to the inside face 42 of the respective support 14. The motor 50 is operationally coupled to the power module 46 and the gearbox 40. A switch 52 is coupled to the first housing 44. The switch 52 is operationally coupled to the motor 50 and the power module 46. The switch 52 is positioned to couple the motor 50 to the power module 46 such that the motor 50 is compelled to rotate the axle 20.

In another embodiment, a central processing unit 54 and a speaker 56 are coupled to and positioned in the first housing 44. The central processing unit 54 is operationally coupled to the power module 46. The central processing unit 54 is configured to receive audio signals. The speaker 56 is operationally coupled to the central processing unit 54. The central processing unit 54 is positioned to receive audio signals and relay the audio signals to the speaker 56, such that the audio signals are broadcast to a child positioned in the seat 30.

In yet another embodiment of the invention, the actuator 34 comprises a second housing 58 that is coupled to the outside face 36 of the respective support 14. The second housing 58 is substantially rectangularly box shaped. A sprocket 60 is positioned in the second housing 58 and is operationally coupled to the gearbox 40. A spring 62 is operationally coupled to the sprocket 60. A winder 64 is positioned through a front wall 66 of the second housing 58. The winder 64 is operationally coupled to the spring 62. The winder 64 is positioned on the second housing 58 such that the winder 64 is configured to be turned by a user. Torsional energy is stored in the spring 62, such that the spring 62 is positioned to rotate the sprocket 60, wherein the sprocket 60 rotates the axle 20.

In use, the gearbox 40 is positioned to provide speed and torque conversion between the crank handle 38 and the axle 20. The crank handle 38 is positioned to motivate rotation of the axle 20 such that the flanges 22, the crossbars 26, the seat 30 and a child positioned in the seat 30 rotate vertically around the axle 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A vertically rotating chair assembly comprising:

a plate;

a pair of supports coupled singly to opposing edges of said plate, said supports extending substantially vertically from said plate;

an axle rotatably coupled to and extending between said supports distal from said plate;

a pair of flanges coupled singly proximate to opposing ends of said axle;

a plurality of crossbars coupled to and extending between said flanges proximate to circumferences of said flanges;

a seat, said seat having a pair of sidewalls coupled to and extending from a seat bottom and a seat backrest, said sidewalls being spaced such that said seat is configured for holding a single child therein, each of said sidewalls being rotatably coupled to a respective said crossbar such that said seat occupies a break in said crossbar, said seat being configured for positioning of the child;

an actuator coupled to an outside face of a respective said support, said actuator being operationally coupled to said axle; and wherein said actuator is positioned to motivate rotation of said axle such that said flanges, said crossbars, said seat and a child positioned in said seat rotate vertically around said axle.

2. The assembly of claim 1, further comprising:

said plate being substantially rectangularly shaped;

said supports being substantially triangularly shaped; and said flanges being substantially circularly shaped.

3. The assembly of claim 2, further including a pair of cutouts, each said cutout being substantially centrally positioned through a respective said support, said cutouts being substantially triangularly shaped.

4. The assembly of claim 1, further including said plurality of crossbars comprising four said crossbars evenly spaced around said circumferences, said crossbars being circularly shaped when viewed longitudinally.

5. The assembly of claim 1, further including a harness coupled to said seat, said harness being configured for positioning over the child positioned in said seat such that the child is coupled to said seat.

6. The assembly of claim 1, further including a gearbox coupled to an inside face of said respective said support, said gearbox being operationally coupled to said actuator and said axle, wherein said gearbox is positioned to provide speed and torque conversion between said actuator and said axle.

7. The assembly of claim 6, further including said actuator comprising a crank handle.

8. The assembly of claim 6, further including said actuator comprising:

a first housing coupled to said outside face of said respective said support, said first housing being substantially rectangularly box shaped;

a power module coupled to and positioned in said first housing;

a motor coupled to said inside face of said respective said support, said motor being operationally coupled to said power module and said gearbox;

a switch coupled to said first housing, said switch being operationally coupled to said motor and said power module; and wherein said switch is positioned to couple said motor to said power module such that said motor is compelled to rotate said axle.

9. The assembly of claim 8, further including said power module comprising at least one battery.

10. The assembly of claim 8, further including comprising:

a central processing unit coupled to and positioned in said first housing, said central processing unit being operationally coupled to said power module, said central processing unit being configured for receiving audio signals;

a speaker coupled to and positioned in said first housing, said speaker being operationally coupled to said central processing unit; and wherein said central processing unit is positioned to receive audio signals and relay the audio signals to said speaker such that the audio signals are broadcast to a child positioned in said seat.

11. The assembly of claim 6, further including said actuator comprising:

a second housing coupled to said outside face of said respective said support, said second housing being substantially rectangularly box shaped;

a sprocket positioned in said second housing and operationally coupled to said gearbox;

a spring operationally coupled to said sprocket;

a winder positioned through a front wall of said second housing, said winder being operationally coupled to said spring; and wherein said winder is positioned on said second housing such that said winder is configured for turning by a user such that torsional energy is stored in said spring, such that said spring is positioned to rotate said sprocket such that said sprocket is compelled to rotate said axle.

12. A vertically rotating chair assembly comprising:

a plate, said plate being substantially rectangularly shaped;

a pair of supports coupled singly to opposing edges of said plate, said supports extending substantially vertically from said plate, said supports being substantially triangularly shaped;

a pair of cutouts, each said cutout being substantially centrally positioned through a respective said support, said cutouts being substantially triangularly shaped;

an axle rotatably coupled to and extending between said supports distal from said plate;

a pair of flanges coupled singly proximate to opposing ends of said axle, said flanges being substantially circularly shaped;

a plurality of crossbars coupled to and extending between said flanges proximate to circumferences of said flanges, said plurality of crossbars comprising four said crossbars evenly spaced around said circumferences, said crossbars being circularly shaped when viewed longitudinally;

a seat, said seat having a pair of sidewalls coupled to and extending from a seat bottom and a seat backrest, said sidewalls being spaced such that said seat is configured for holding a single child therein, each of said sidewalls being rotatably coupled to a respective said crossbar such that said seat occupies a break in said crossbar, said seat being configured for positioning of the child;

a harness coupled to said seat, said harness being configured for positioning over the child positioned in said seat such that the child is coupled to said seat;

an actuator coupled to an outside face of a respective said support, said actuator being operationally coupled to said axle, said actuator comprising a crank handle;

a gearbox coupled to an inside face of said respective said support, said gearbox being operationally coupled to said actuator and said axle, wherein said gearbox is positioned to provide speed and torque conversion between said actuator and said axle, and wherein said gearbox is positioned to provide speed and torque conversion between said crank handle and said axle such that said crank handle is positioned to motivate rotation of said axle such that said flanges, said crossbars, said seat and a child positioned in said seat rotate vertically around said axle.

13. The assembly of claim 12, further including said actuator comprising:

a first housing coupled to said outside face of said respective said support, said first housing being substantially rectangularly box shaped;

a power module coupled to and positioned in said first housing, said power module comprising at least one battery, a motor coupled to said inside face of said respective said support, said motor being operationally coupled to said power module and said gearbox;

a switch coupled to said first housing, said switch being operationally coupled to said motor and said power module; and wherein said switch is positioned to couple said motor to said power module such that said motor is compelled to rotate said axle.

14. The assembly of claim 13, further including a central processing unit coupled to and positioned in said first housing, said central processing unit being operationally coupled to said power module, said central processing unit being configured for receiving audio signals;

a speaker coupled to and positioned in said first housing, said speaker being operationally coupled to said central processing unit; and wherein said central processing unit is positioned to receive audio signals and relay the audio signals to said speaker such that the audio signals are broadcast to a child positioned in said seat.

15. The assembly of claim 12, further including said actuator comprising:

a second housing coupled to said outside face of said respective said support, said second housing being substantially rectangularly box shaped;

a sprocket positioned in said second housing and operationally coupled to said gearbox;

a spring operationally coupled to said sprocket;

a winder positioned through a front wall of said second housing, said winder being operationally coupled to said spring; and wherein said winder is positioned on said second housing such that said winder is configured for turning by a user such that torsional energy is stored in said spring, such that said spring is positioned to rotate said sprocket such that said sprocket is compelled to rotate said axle.

* * * * *